US010188574B2

(12) United States Patent
Koller-Hodac et al.

(10) Patent No.: US 10,188,574 B2
(45) Date of Patent: Jan. 29, 2019

(54) PATELLA GRIPPER AND DEVICE FOR MOVING A PATELLA COMPRISING SUCH A PATELLA GRIPPER

(75) Inventors: Agathe Koller-Hodac, Richterswil (CH); Domenico Leonardo, Wadenswil (CH); Manuel Altmeyer, Rapperswil (CH); Silvio Walpen, Wadenswil (CH); Daniel Felder, Rapperswil (CH)

(73) Assignee: HSR Hochschule für Technik Rapperswil, Rapperswil (CH)

( * ) Notice: Subject to any disclaimer, the term of this patent is extended or adjusted under 35 U.S.C. 154(b) by 1263 days.

(21) Appl. No.: 13/823,917

(22) PCT Filed: Aug. 8, 2011

(86) PCT No.: PCT/CH2011/000177

§ 371 (c)(1),
(2), (4) Date: May 24, 2013

(87) PCT Pub. No.: WO2012/034239

PCT Pub. Date: Mar. 22, 2012

(65) Prior Publication Data

US 2013/0233323 A1 Sep. 12, 2013

(30) Foreign Application Priority Data

Sep. 16, 2010 (CH) ..... 1509/10

(51) Int. Cl.
*A61H 23/02* (2006.01)
*A61H 23/04* (2006.01)
(Continued)

(52) U.S. Cl.
CPC ..... *A61G 99/00* (2013.01); *A61H 1/008* (2013.01); *A61H 1/02* (2013.01); *A61H 23/02* (2013.01);
(Continued)

(58) Field of Classification Search
CPC ..... A61B 5/103; A61G 99/00; A61H 1/02; A61H 1/024; A61H 1/005; A61H 23/04;
(Continued)

(56) References Cited

U.S. PATENT DOCUMENTS 3,672,355 A * 6/1972 Ogawa ..... A61H 23/0263 601/135
4,287,885 A * 9/1981 Applegate ..... A61F 13/061 2/24
(Continued)

FOREIGN PATENT DOCUMENTS

CN 2173056 Y 8/1994
DE 102007063383 A1 6/2009
GB 2463061 B 4/2011

OTHER PUBLICATIONS

Schabus et al.; "The Knee—Diagnosis, Therapy and Rehabilitation"; 2007; pp. 24-31; Springer Verlag.
(Continued)

*Primary Examiner* — Kari Rodriquez
*Assistant Examiner* — Camtu Nguyen
(74) *Attorney, Agent, or Firm* — The Webb Law Firm

(57) ABSTRACT

The invention relates to a patella gripper for a patella, comprising a retaining element (3; 53) and a contact finger apparatus (4; 54), wherein the contact finger apparatus (4; 54) is arranged on the lower face of the retaining element (3; 53), wherein the contact finger apparatus (4; 54) comprises at least two contact finger units (4.1, 4.2; 54.1), which are arranged on opposite sides of the retaining element (3; 53), and wherein the contact finger apparatus (4; 54) is designed in such a way that the patella can be moved in the cranial-caudal direction and in the medial-lateral direction by means of the contact finger units (4.1, 4.2; 54.1). The invention further relates to a device (20; 60) having such a patella gripper (1; 51).

20 Claims, 13 Drawing Sheets

(51) Int. Cl.
*A61G 99/00* (2006.01)
*A61H 1/00* (2006.01)
*A61H 1/02* (2006.01)

(52) U.S. Cl.
CPC ..... *A61H 23/04* (2013.01); *A61G 2203/46* (2013.01); *A61H 2201/1642* (2013.01); *A61H 2201/5061* (2013.01); *A61H 2201/5071* (2013.01); *A61H 2205/104* (2013.01)

(58) Field of Classification Search
CPC ..... A61H 2001/0203; A61H 23/004; A61H 23/06; A61H 23/006; A61H 2015/0007; A61H 2015/0042; A61H 2015/0064; A61H 2205/102; A61H 2205/104; A61H 15/0078; A61H 15/0092; A61H 2201/0157; A61H 2201/0153; A61H 2201/1238; A61H 2201/1409; A61H 2201/1602; A61H 2201/1664; A61H 2201/1666; A61H 2201/5051; A61H 2201/5061; A61H 2201/5058; A61H 2201/5056; A61H 1/008; A61H 23/02
USPC ..... 600/595; 601/5; 602/13, 26
See application file for complete search history.

(56) References Cited

U.S. PATENT DOCUMENTS 4,414,963 A * 11/1983 Kunz ..... A61H 7/004 601/134
4,856,496 A * 8/1989 Chursinoff ..... A61H 7/001 601/104
5,156,163 A 10/1992 Watkins et al.
5,333,604 A * 8/1994 Green ..... A61H 1/0255 601/33
5,634,905 A * 6/1997 Rudolph, Jr. ..... A61M 5/165 210/436
5,676,527 A * 10/1997 Ogikubo ..... F04B 43/04 417/218
5,792,084 A * 8/1998 Wilson ..... A61F 5/012 602/13
6,013,039 A 1/2000 Watkins et al.
7,264,598 B2 * 9/2007 Shin ..... A61H 7/004 601/112
2007/0179414 A1 * 8/2007 Imboden ..... A61H 19/00 601/72
2008/0194997 A1 * 8/2008 Zhang ..... A61B 5/1071 600/595
2008/0294079 A1 * 11/2008 Sterling ..... A61F 5/012 602/13
2009/0163823 A1 * 6/2009 Takahashi ..... A61B 5/02225 600/490
2009/0239056 A1 9/2009 Andritzke et al.
2010/0191160 A1 * 7/2010 Avramovich ..... A61H 7/004 601/94

OTHER PUBLICATIONS

Agneskircher et al.; "Endoprothetik des Kniegelenks" [Endoprosthetics of the Knee Joint]; Unfallchirurg; 2004; 107:219-231.
Larsen; "Trainieren stall Operieren?" [Exercise Instead of surgery?]; Schweizerische Ärztezeitung; 2009; 90 (38): 1476-1479.
Kokmeyer; "Tutorials on Rehabilitation of Knee Patients with Arthrofibrosis"; 2007; 6 pages; Kneeguru Information Hub.
Stalzer et al.; "Rehabilitation Principles, in: The Crucial Principles in Care of the Knee"; editors: Feagin, J.A. Jr. and Steadman, J.R.; 2008; pp. 203-219; Lippincott Williams and Wilkins, Philadelphia.
Heckmann et al.; "Rehabilitation of Primary and Revision Anterior Cruciate Ligament Reconstructions, in: Noyes Knee Disorders Surgery, Rehabilitation, Clinical Outcomes"; editor: Noyes, F.R.; 2010; pp. 306-336; Saunders Elsevier, Philadelphia; Stalzer, S., Atkins, J., Hagerman, G., Rehabilitation Principles, in: The Crucial Principles in Care of the Knee; editors: Feagin, J.A. Jr, and Steadman, J.R., 2008, Lippincott Williams and Wilkins, Philadelphia.
Lenssen et al.; "Effectiveness of Prolonged Use of Continuous Passive Motion (CPM), as an Adjunct to Physiotherapy, After Total Knee Arthroplasty"; BMC Musculoskeletal Disorders; 2008; 11 pages; 9:60.
Salter et al.; "Clinical Application of Basic Research on Continuous Passive Motion for Disorders and Injuries of Synovial Joints: A Preliminary Report of a Feasibility Study"; J. Orthop. Res.; 1984, 1:325-342.
Cavanaugh; "Rehabilitation for Nonoperative and Operative Management of Knee Injuries, in: The Adult Knee"; editors: Callaghan, J.J., Rosenberg, A.G., Rubash, H.E., Simonian, P.T. and Wickiewicz, T.L.; 2003; pp. 389-430; Lippincott Williams Wilkins, Philadelphia.

* cited by examiner

PATELLA GRIPPER AND DEVICE FOR MOVING A PATELLA COMPRISING SUCH A PATELLA GRIPPER

FIELD OF THE INVENTION

The invention relates to a patella gripper, to a device for moving a patella, and to a method for adjusting a device for moving a patella according to the precharacterising parts of the independent claims. The term "patella" refers to a kneecap.

STATE OF THE ART

The knee is the largest and most complex joint in the human body and can be affected both by degenerative and by traumatic disorders. With an increase in the ageing of the population, a continuous increase of degenerative knee disorders has been observed (Schabus, R. and Bosina, E., The Knee—Diagnosis, Therapy and Rehabilitation, 2007, Springer Verlag), which disorders, as a rule, result in defects in the articular cartilage of the knee. In 2006 such defects in the knee joint cartilage resulted in 11,026 knee replacements in Switzerland, and according to an estimate from 2004 to more than 500,000 complete knee replacements worldwide (Agneskircher, J. D. and Lobenhofer, P., "Endoprothetik des Kniegelenks" [endoprosthetics of the knee joint], Unfallchirurg, 2004, 107:219-231; Larsen, Ch., "Trainieren statt Operieren?" [exercise instead of surgery?], Schweizerische Ärztezeitung, 2009, 90 (38): 1476-1479). Furthermore, traumatic lesions of the anterior and/or posterior cruciate ligaments often require surgical intervention (Schabus, R. and Bosina, E., The Knee—Diagnosis, Therapy and Rehabilitation, 2007, Springer Verlag). The term patella refers to the kneecap, the movable bone covering the anterior surface of the knee joint, which bone is integrated in a tendon that connects the quadriceps muscles with the femur and tibia. Articular cartilage covers the back of the patella. Mobilising or moving this knee region is extremely important in the rehabilitation process in order to prevent sticking of the knee and the knee joint.

As a rule, after a knee injury or after knee surgery, patients undergo intensive rehabilitation therapy. It is the objective of such rehabilitation therapy to reduce any swelling, to prevent further inflammation, to maintain or restore the mobility of the knee by means of a number of passive movement exercises, to maintain or restore the mobility of the patella, and to preserve the strength of the quadriceps and of the hamstring (anterior thigh muscles) (Kokmeyer, D., Tutorials on Rehabilitation of Knee Patients with Arthrofibrosis, 2007, Kneeguru Information Hub; Stalzer, S., Atkins, J., Hagerman, G., Rehabilitation Principles, in: The Crucial Principles in Care of the Knee; editors: Feagin, J. A. Jr. and Steadman, J. R., 2008, Lippincott Williams and Wilkins, Philadelphia).

Following knee surgery, patients typically receive rehabilitation therapy in specialised orthopaedic clinics and rehabilitation centres, for example in sports clinics. Maintaining mobility of the patella and of the associated tendon is essential in order to regain the normal range of motion (ROM) and in order to prevent adhesion in the connection between the patella and the femur (Heckmann, T. P., Noyes, F. R., Barber-Westin, S. D., Rehabilitation of Primary and Revision Anterior Cruciate Ligament Reconstructions, in: Noyes Knee Disorders Surgery, Rehabilitation, Clinical Outcomes; editor: Noyes, F. R., 2010, Saunders Elsevier, Philadelphia; Stalzer, S., Atkins, J., Hagerman, G., Rehabilitation Principles, in: The Crucial Principles in Care of the Knee; editors: Feagin, J. A. Jr. and Steadman, J. R., 2008, Lippincott Williams and Wilkins, Philadelphia). Indeed, good mobility of the patella is extremely important to full functionality of the knee (Cavanaugh, J. T., Rehabilitation for Nonoperative and Operative Management of Knee Injuries, in: The Adult Knee; editors: Callaghan, J. J., Rosenberg, A. G., Rubash, H. E., Simonian, P. T. and Wickiewicz, T. L., 2003, Lippincott Williams Wilkins, Philadelphia).

During rehabilitation therapy the patella is, as a rule, repeatedly deflected from its normal position. Deflecting the patella from its normal position is to prevent it from adhering to the patella groove, provided in the femur, as a result of possible haemorrhaging in the interior of the knee. Such adhesion of the patella results in deterioration of the mobility of the knee, in increased stiffness and instability of the knee joint, and in increased pain. Thus, deflection from the normal position is used to preserve the freedom of movement and the mobility of the knee joint and of the knee.

In order to prevent adhesion of the patella, physiotherapists move the patella, as a rule manually, based on years of practical knowledge and experience. Manually moving the patella needs to be carried out by a physiotherapist several times each day for several days. In this process the patella is manually moved in the medial-lateral direction and in the cranial-caudal direction (Heckmann, T. P., Noyes, F. R., Barber-Westin, S. D., Rehabilitation of Primary and Revision Anterior Cruciate Ligament Reconstructions, in: Noyes Knee Disorders Surgery, Rehabilitation, Clinical Outcomes; editor: Noyes, F. R., 2010, Saunders Elsevier, Philadelphia; Stalzer, S., Atkins, J., Hagerman, G., Rehabilitation Principles, in: The Crucial Principles in Care of the Knee; editors: Feagin, J. A. Jr. and Steadman, J. R., 2008, Lippincott Williams and Wilkins, Philadelphia). During movement in the medial-lateral direction the patella is moved from its centre in the transverse direction towards each side. During movement in the cranial-caudal direction the patella is moved in the longitudinal direction upwards and downwards, i.e. towards the head and towards the opposite, lower, end of the body. The terms "longitudinal direction" and "transverse direction" refer to the leg of the patient.

Since physiotherapists need to be involved, this manual procedure is relatively cost-intensive. Furthermore, as a result of its monotony, the procedure is not particularly appreciated by physiotherapists. Consequently, manually moving the patella is not often practised, and in many clinics and rehabilitation centres it is not even offered at all.

Patients are instructed by physiotherapists to themselves at home move the patella, after being discharged from the clinic or from the rehabilitation centre, in the medial-lateral direction and in the cranial-caudal direction several times a day for several weeks. Typically, patients are to move the patella at home in this manner two to three times per day for approximately 10 to 15 minutes up to the sixth week after surgery. However, a lack of self-discipline and motivation, patients' fear of doing something wrong when moving the patella, and physical difficulties when patients themselves carry out the manual movement of the patella often lead to very varying results of such self-directed therapy, and frequently optimal healing is prevented. For example, in this form of manual therapy patients themselves need to move the patella with the leg outstretched, with several groups of leg muscles having to be relaxed during this process. However, many patients experience considerable difficulties in this process, especially if they are at the same time to manually move the patella on their own leg.

For mobilising the knee joint in the longitudinal direction it is possible to use passive motion devices that carry out continuous movement of the patella, generally known as continuous passive motion (CPM). These passive motion devices are driven by an external motor; they move the leg in a controlled manner within the scope of predefined bending of the knee joint, wherein the muscles remain passive (U.S. Pat. No. 5,333,604 A; Stalzer, S., Atkins, J., Hagerman, G., Rehabilitation Principles, in: The Crucial Principles in Care of the Knee; editors: Feagin, J. A. Jr. and Steadman, J. R., 2008, Lippincott Williams and Wilkins, Philadelphia; Lenssen, T. A. F., van Steyn, M. J. A., Crijns, Y. H. F., Waltj, E. M. H., Roox, G. M., Geesin, R. J. T., van den Brandt, P. A., De Bie, R. A., Effectiveness of Prolonged Use of Continuous Passive Motion (CPM), as an Adjunct to Physiotherapy, After Total Knee Arthroplasty, BMC Musculoskeletal Disorders, 2008, 9:60; Salter, R. B., Hamilton, H. W., Wedge, J. H., Tile, M., Torode, I. P., O'Driscoll, S. W., Murnaghan, J. J., Saringer, J. H., Clinical Application of Basic Research on Continuous Passive Motion for Disorders and Injuries of Synovial Joints: A Preliminary Report of a Feasibility Study, J. Orthop. Res., 1984, 1:325-342). By means of these passive motion devices the knee joint is automatically bent, and in this process mobility is improved. However, this device contributes only indirectly to preventing adhesion of the patella. This is the case because the patella is moved only in the longitudinal direction, which does not, however, correspond to the optimal movement sequences that are to be carried out by the patella during rehabilitation therapy. Furthermore, the known passive motion devices do not comprise any sensors or any control device by means of which the movement sequences of the knee and of the patella could be monitored. Manufacturers of such passive motion devices include, for example, the following enterprises: Sutter in the USA, Chattanooga Group, Astromot, Danniger and Kinetec.

PRESENTATION OF THE INVENTION

It is the object of the invention to provide a patella gripper by means of which a patella can be moved. Furthermore, it is the object of the invention to provide a device for moving a patella, which device can automatically move the patella. Furthermore, it is the object of the invention to provide a method for adjusting the device for moving a patella.

These objects are met by a patella gripper, by a device for moving a patella, and by a method for adjusting a device for moving a patella, with the characteristics of the independent claims. A knee cap gripper is also called a patella gripper.

The patella gripper according to the invention for a patella comprises a retaining element and a contact finger apparatus, wherein the contact finger apparatus is arranged on the lower face of the retaining element. The lower face of the retaining element is that face which in the application of the patella gripper faces the knee. The upper face of the retaining element is the face opposite the lower face. The contact finger apparatus comprises at least two contact finger units, which are arranged on opposite sides on the lower face of the retaining element, wherein the contact finger apparatus is designed in such a manner that the patella can be moved in the cranial-caudal direction and in the medial-lateral direction by means of the contact finger units. In this process, movement in the cranial-caudal direction and in the medial-lateral direction takes place gradually, wherein the sequence is variable. The movement in the cranial-caudal direction also comprises a movement in the caudal-cranial direction. According to a preferred embodiment of the patella gripper according to the invention, the contact finger apparatus in the longitudinal direction comprises two contact finger units arranged on the retaining element on opposite sides of the transverse axis of the retaining element. These contact finger units are adjustable in the longitudinal direction. They are used to move a patella in the cranial-caudal direction. The longitudinal direction corresponds to the longitudinal direction of a leg of a patient. The cranial-caudal direction is defined as the direction from the head to the opposite end of the body, i.e. to the feet, of a patient. Furthermore, the contact finger apparatus according to the preferred embodiment comprises two contact finger units provided in the transverse direction of the retaining element, wherein these contact finger units are arranged on opposite sides of the longitudinal axis of the retaining element. These contact finger units are adjustable in the transverse direction. They are used for moving the patella in the medial-lateral direction. The transverse direction corresponds to the transverse direction of a leg of a patient. The medial-lateral direction comprises the directions from the centre of the patella towards its sides, i.e. laterally to the cranial-caudal direction.

According to a further preferred embodiment of the patella gripper according to the invention, the contact finger apparatus is rotatably arranged on the retaining element so that it can be rotated on an axis that is aligned perpendicularly to the longitudinal axis of the retaining element and perpendicularly to the transverse axis of the retaining element, i.e. on a vertical axis or Z-axis, that is to say in particular by 90 degrees. The contact finger apparatus comprises two contact finger units that are arranged on opposite sides on the lower face of the retaining element. In the home position the contact finger units are preferably arranged in the longitudinal direction on opposite sides of the transverse axis or in the transverse direction on opposite sides of the longitudinal axis of the retaining element.

On the upper face of the retaining element a handle for guiding the patella gripper and/or for rotating the contact finger apparatus can be provided. All the contact finger units are preferably height-adjustable. Preferably, the contact finger units comprise one or several contact fingers.

The device according to the invention for moving a patella comprises a patella gripper according to the invention and a leg holding device. Furthermore, one or several drive units for moving the contact finger units of the patella gripper in the cranial-caudal direction (i.e. in the longitudinal direction) or in the medial-lateral direction (i.e. in the transverse direction) and a control unit for controlling the one or several drive units are provided. The term "moving a patella" also refers to mobilising a patella. The one or several drive units can move the contact finger units directly or indirectly by moving the entire patella gripper.

The patella gripper according to the invention and the device according to the invention for moving a patella can both be used in clinically-supervised rehabilitation therapies and in unsupervised rehabilitation therapies carried out by patients themselves. Since by means of the correspondingly designed contact finger apparatus it is possible to achieve both movement of the patella in the cranial-caudal direction and movement in the medial-lateral direction, the healing process following knee surgery can be improved and in some cases also accelerated when compared to that using conventional methods. Often, mobilisation of the knee joint already prior to surgery makes sense, wherein for this, too, the patella gripper according to the invention and the device according to the invention can be used. With the use of the device according to the invention the patella can automatically in a regular and repeatable manner be moved in the cranial-caudal direction and in the medial-lateral direction.

Consequently, movement of the patella no longer needs to be carried out by a physiotherapist. The physiotherapist is thus relieved from this quite monotonous and time-consuming activity, and cost savings during rehabilitation therapy can be achieved.

In the method according to the invention for adjusting the device according to the invention for moving a patella, the device is made to assume a teach-in phase (also referred to as a "teach-in mode") in that an activation button provided on the device is pushed. Prior to this the patella gripper has been placed on the patella of the patient by a physiotherapist or by the patient themselves. As an alternative, the patella gripper according to the invention can also have been placed on a patella of a patient by means of the control unit. The position in which the patella gripper is located following placement represents the initial position or zero position of the patella gripper, which position is preferably stored in the control device, for example by activating an operating element provided on the patella gripper. Preferably only when the zero position has been defined in this manner in relation to the transverse axis and the longitudinal axis of the patella gripper is it possible to move the patella gripper in the direction to be taught, i.e. movement in the next direction to be taught is released or unlocked only at this stage.

Subsequently, by means of the control unit, the contact finger units are moved, by way of a drive unit, in the cranial-caudal direction towards the head of the patient until the patient operates the activation button again, wherein the value of the force acting on the patella at the point in time of operating the activation button and/or the value of the maximum deflection of the patella gripper or of the contact finger units are/is directly or indirectly stored in the device (first cranial-caudal procedural step). Furthermore, by means of the control unit, the contact finger units are moved, by way of the drive unit, in the cranial-caudal direction towards the end of the body of the patient, which end is opposite the head, until the patient operates the activation button, wherein again the value of the force acting on the patella at the point in time of operating the activation button and/or the value of the maximum deflection of the patella gripper or of the contact finger units are/is directly or indirectly stored in the device (second cranial-caudal procedural step). The term "operating an activation button" among other thing refers either to pushing the activation button or to releasing the activation button that has been held so as to be pushed in.

After completion of the first and the second cranial-caudal procedural steps, by means of the control unit the patella gripper is preferably moved back to the zero position. Thereafter, by means of the control unit, the contact finger units, by way of the same or of another drive unit, are moved in the medial-lateral direction from an initial position towards the left-hand side of the body of the patient, when viewed from the patient, until the patient operates the activation button, wherein again the value of the force acting on the patella at the point in time of operating the activation button and/or the value of the maximum deflection of the patella gripper or of the contact finger units are/is directly or indirectly stored in the device (first medial-lateral procedural step).

Finally, by means of the control unit, the contact finger units, by way of the same drive unit as in the last procedural step, are moved in the medial-lateral direction from the initial position towards the right-hand side of the body of the patient, when viewed from the patient, until the patient operates the activation button, wherein again the value of the force acting on the patella at the point in time of operating the activation button and/or the value of the maximum deflection of the patella gripper or of the contact finger units are/is directly or indirectly stored in the device (first medial-lateral procedural step).

The term "direct storage of the force applied" refers to the storage of the actual force applied, which force has been measured by means of one or several force sensors. The term "indirect storage of the force applied" refers to the storage of a measured quantity from which the force applied can be derived. This can, for example, be the pressure measured by means of one or several pressure sensor units (in the case of the design of the one or several drive units as a fluidic pump or as fluidic pumps). The movement of the contact finger units can take place directly (even without movement of the retaining element) or by movement of the patella gripper. The term "direct storage of the deflection of the patella gripper or of the contact finger units" refers to the storage of the actual deflection measured by means of one or several linear sensor units (in the following also called linear sensor units). The term "indirect storage of this deflection" refers to the storage of a measured quantity from which the deflection can be derived. This can, for example, be a combination of the measured or of the predetermined rotational speed value relating to the fluidic pump and of the measured time (i.e. the time that has lapsed since commencement of the deflection in a specific direction) (in the case of the design of the one or several drive units as a fluidic pump or as fluidic pumps).

In the method according to the invention the sequence of the first cranial-caudal procedural step, of the second cranial-caudal procedural step, of the first medial-lateral procedural step and of the second medial-lateral procedural step is discretionary, i.e. these procedural steps can be carried out in any desired sequence. Between a cranial-caudal procedural step and a medial-lateral procedural step (and vice versa) rotation of the contact finger apparatus by 90 degrees takes place when the contact finger apparatus comprises only two opposite contact finger units and is designed so as to be rotatable.

The method according to the invention for adjusting the device according to the invention advantageously is carried out in an automatic or automated manner so that it can also be carried out by patients themselves without the assistance of a physiotherapist. By means of the renewed carrying out of the method according to the invention the device and thus the rehabilitation therapy can be adapted to the healing process of a patient.

BRIEF DESCRIPTION OF THE DRAWINGS

Further exemplary embodiments of the invention are stated in the dependent claims and in the exemplary embodiments, shown below with reference to the drawings. The following are shown:

In the figures the same reference characters denote identical components or components having the same effect.

WAY(S) OF IMPLEMENTING THE INVENTION

Figure 1:
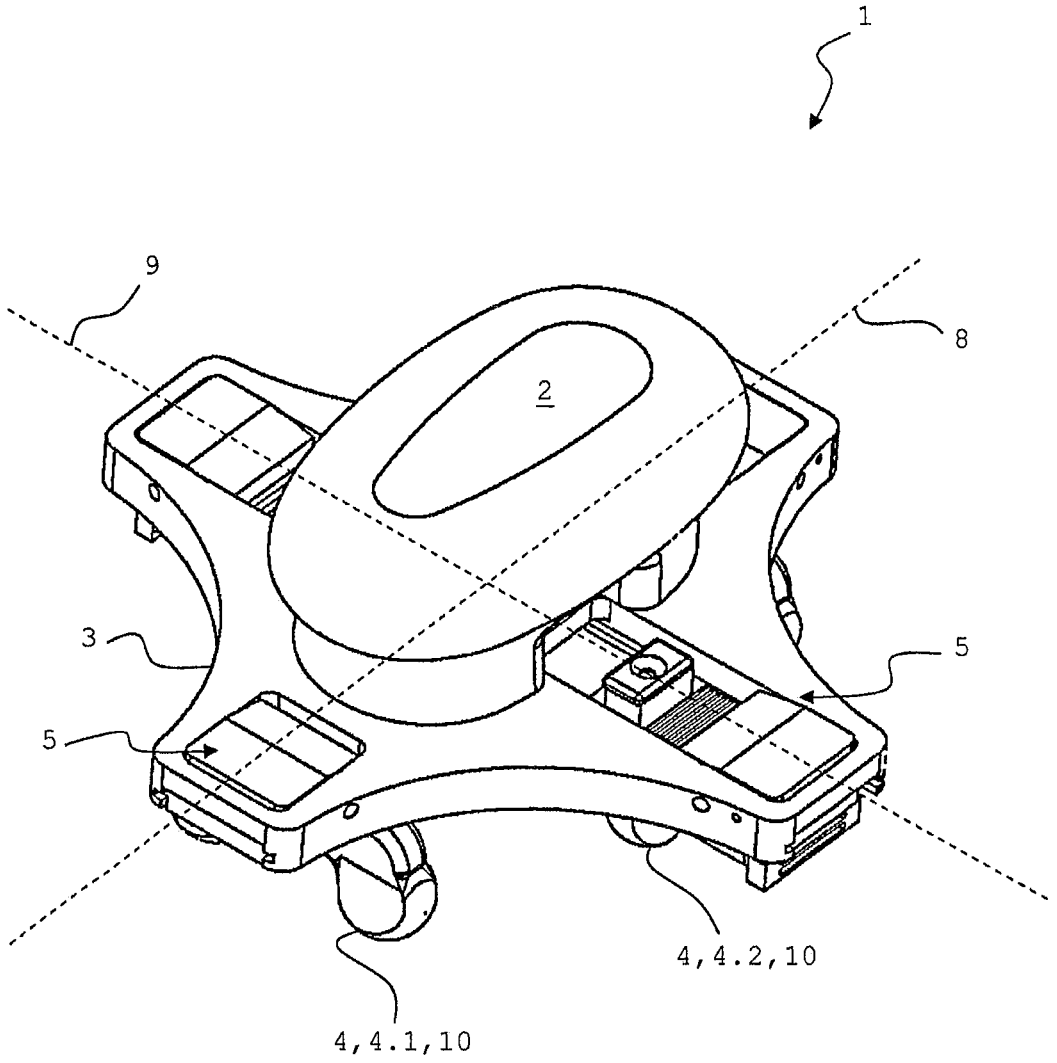
FIG. 1 a perspective top view of a first exemplary embodiment of a patella gripper according to the invention, FIG. 2 a perspective bottom view of a first exemplary embodiment of a patella gripper according to the invention, FIG. 3 a perspective view of a first exemplary embodiment of a device according to the invention for moving a patella, FIG. 4 a further perspective view of a first exemplary embodiment of a device according to the invention for moving a patella with a diagrammatically shown leg section of a patient, FIG. 5 the view according to FIG. 4, wherein a first exemplary embodiment of the patella gripper according to the invention has been placed on the leg section of the patient, FIG. 6 a further perspective view of a first exemplary embodiment of a device according to the invention for moving a patella with a leg section of a patient, FIG. 7 a block diagram of a first exemplary embodiment of a device according to the invention for moving a patella, FIG. 8 a diagrammatic view of the leg holding device of a first exemplary embodiment of a device according to the invention for moving a patella with the leg put in place, FIG. 9 a flow chart showing the adjustment and operation of the first exemplary embodiment of the device according to the invention for moving a patella, FIG. 10 a graphic representation of the measured force, applied by the first exemplary embodiment of the device according to the invention, in the cranial-caudal direction as a function of time, FIG. 11 a graphic representation of the measured force, applied by the first exemplary embodiment of the device according to the invention, in the cranial-caudal direction, and of the measured deflection of the patella as a function of time, FIG. 12 a perspective view of a second exemplary embodiment of a patella gripper according to the invention, affixed to a leg section of a patient, and a leg holding device, FIG. 13 a perspective bottom view of a second exemplary embodiment of a patella gripper according to the invention, and FIG. 14 a block diagram of a second exemplary embodiment of a device according to the invention for moving a patella.
Figure 2:
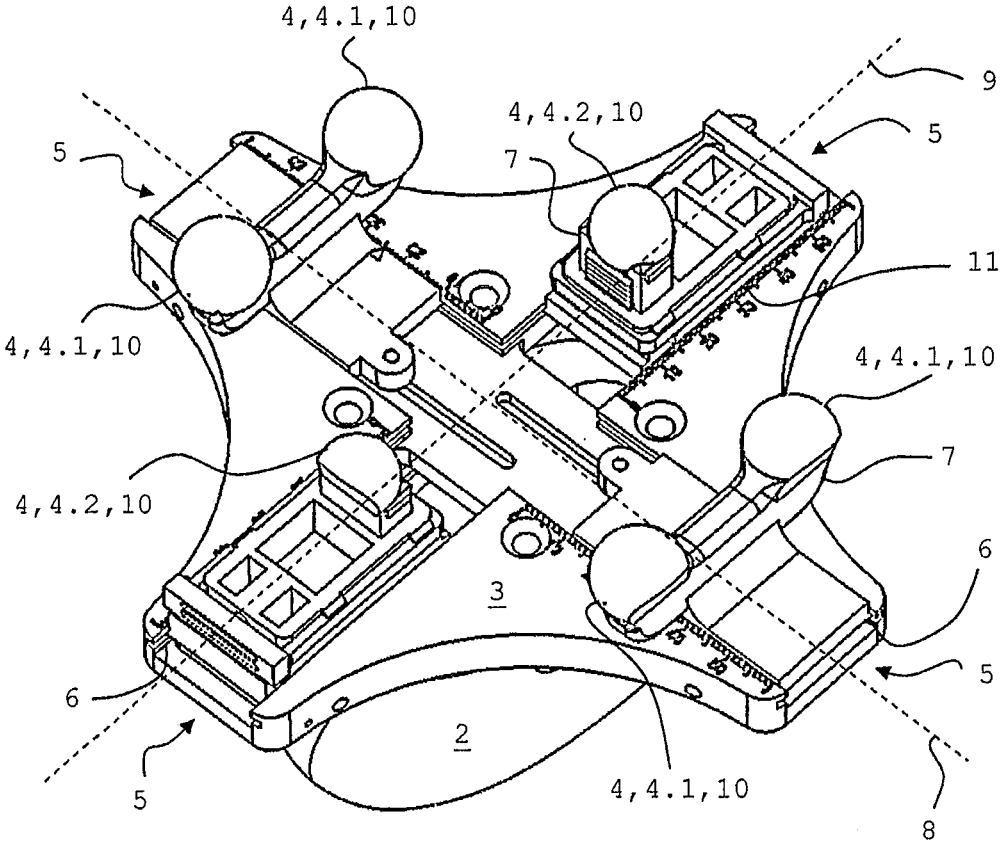
Figure 3:
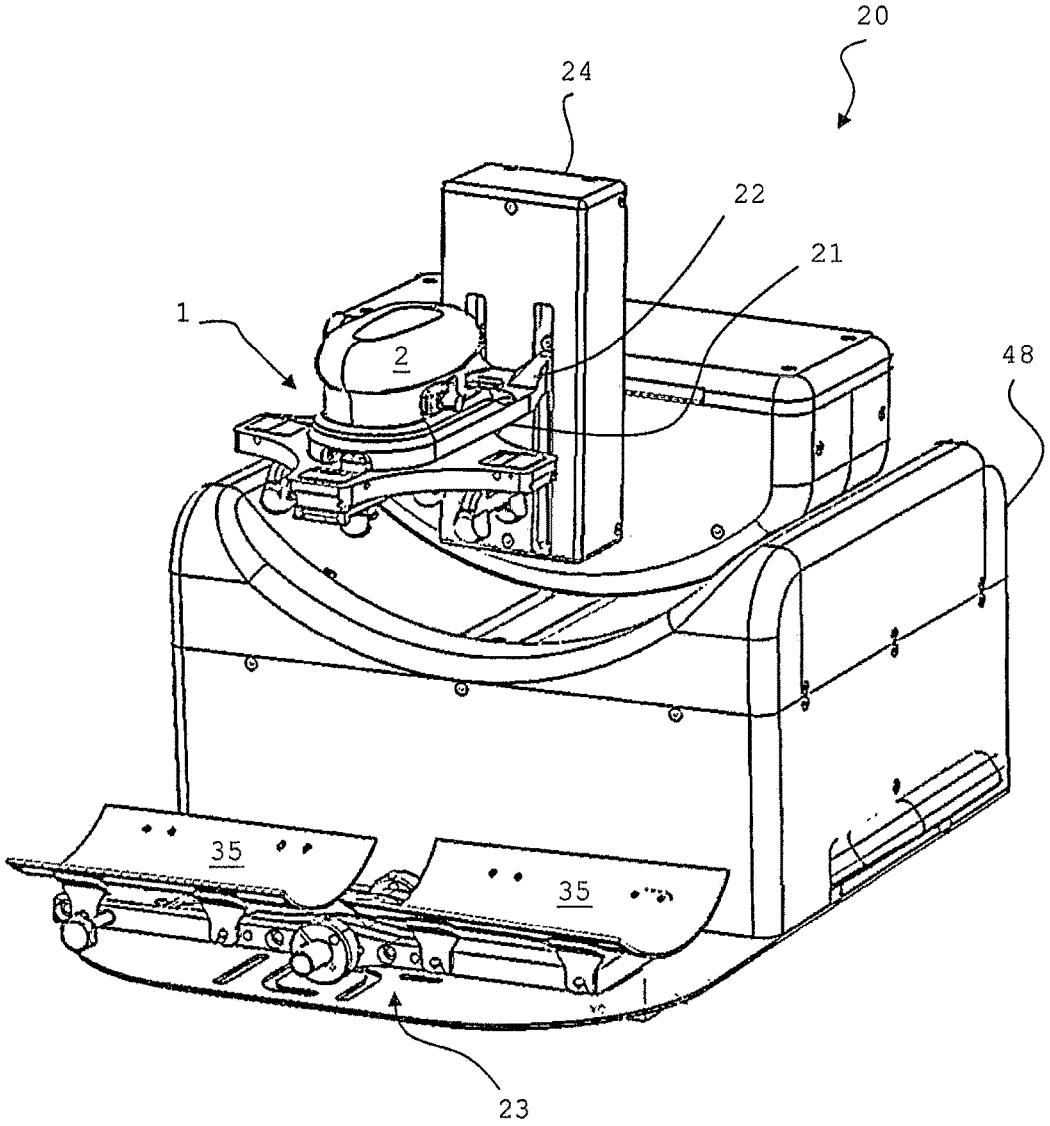

FIGS. 1 and 2 show a first exemplary embodiment 1 of a patella gripper according to the invention. The patella gripper 1 comprises a handle 2, a retaining element 3 and a contact finger apparatus 4 with four contact finger units 4.1, 4.2. The handle 2 is arranged on the upper face of the retaining element 3, and the contact finger apparatus 4 is arranged on the lower face of the retaining element 3. The handle 2 is preferably arranged in the centre on the upper face of the retaining element 3 and is preferably screwed to the retaining element 3. Each contact finger unit 4.1, 4.2 is associated with an adjustment unit 5 that comprises guide rails 6 and a height adjustment unit 7. The handle 2 is optional. Guidance of the patella gripper 1 directly by way of the retaining element 3 is also possible.

In each case two contact finger units 4.1 are arranged on the longitudinal axis 8 of the patella gripper 1 (and thus of the retaining element 3) that is to say in such a manner that in each case a contact finger unit 4.1 is arranged on each side of the transverse axis 9 of the patella gripper 1 or of the retaining element 3. If the patella gripper 1 is placed on a patella of a patient, by corresponding guidance/movement of the patella gripper 1, by way of the contact finger units 4.1, the patella can be moved to and fro in the cranial-caudal direction.

Each contact finger unit 4.1 comprises preferably two contact fingers 10 which in their state attached to a patella grip said patella. The contact fingers 10 are arranged in such a manner that they are situated on opposite sides of the longitudinal axis 8 of the patella gripper 1 or of the retaining element 3. With two contact fingers 10, arranged in this manner, for each contact finger unit 4.1 a particularly good seat of the patella gripper 1 on a patella and a well-guided movement of the patella in the cranial-caudal direction can be caused. Furthermore, when placing the contact finger unit 1 on a leg of the patient it is possible to take into account the presence of any scars, which often extend in the longitudinal direction, and of any swellings, in that in each case one contact finger 10 of each contact finger unit 4.1 is positioned to one side of the scar or of the swelling, and consequently any painful contact with the scar/the swelling is prevented. Of course, depending on the particular application, it is also possible for each contact finger unit 4.1 to comprise more than two or fewer than two contact fingers 10.

Furthermore, in each case two contact finger units 4.2 are arranged on the transverse axis 9 of the patella gripper 1 (and thus of the retaining element 3), that is to say in such a manner that in each case a contact finger unit 4.2 is arranged on each side of the longitudinal axis 8 of the patella gripper 1 or of the retaining element 3. When the patella gripper 1 is applied to a patella of a patient, by means of corresponding guidance/movement of the patella gripper 1, by way of the contact finger units 4.2 the patella can be moved to and fro in the medial-lateral direction.

Each contact finger unit 4.2 comprises preferably one contact finger 10 which in its state attached to a patella grips said patella. The contact fingers 10 are arranged in such a manner that they are situated on the transverse axis 8 of the patella gripper 1 or of the retaining element 3. In this manner a well-guided movement of the patella in the medial-lateral direction can be caused. Of course, each contact finger unit 4.2 can also comprise more than one contact finger 10.

The ends of the contact fingers 10, which ends are further away from the retaining element 3, are preferably spherical in shape in order to allow contact with the leg and the knee of the patient, which contact is agreeable to the patient. At these ends the contact fingers 10 preferably comprise protective hoods (not shown). The protective hoods are preferably made of silicon or a silicon-like material or comprise the aforesaid. The protective hoods are preferably bonded to the ends of the contact fingers 10. By providing such protective hoods it is possible in a better manner to prevent, or at least reduce, the occurrence of pain and irritation that might arise because of the patella gripper establishing contact with the leg of the patient.

The contact finger units 4.1, 4.2 are preferably arranged on the retaining element 3 so as to be height-adjustable by way of the height adjustment units 7 of their associated adjustment units 5. Furthermore, the contact finger units 4.1 are preferably arranged on the retaining element 3 so as to be adjustable in the longitudinal direction, and the contact finger units 4.2 are preferably arranged on the retaining element 3 so as to be adjustable in the transverse direction by way of the guide rails 6 of their associated adjustment units 5, wherein the guide rails 6 of the contact finger units 4.1 extend in the longitudinal direction, and the guide rails 6 of the contact finger units 4.2 extend in the transverse direction. The guide rails 6 and the height adjustment units 7 can comprise click-in points for various positions of the contact finger units 4.1, 4.2 in the longitudinal direction or in the transverse direction and in height. Furthermore, preferably in each case a scale marking or a graduation 11 is associated with the guide rails 6. Correspondingly, in each case a scale marking or a graduation can also be associated with the height adjustment units 7.

By means of the adjustment units 5 the position of the contact finger units 4.1, 4.2 and thus of the contact fingers 10 relative to the knee of the respective patient can be manually adjusted. Moreover, both the vertical and the horizontal position of the patella gripper 1 relative to the knee can be manually adjusted. Manual positioning of the contact finger units 4.1, 4.2 is preferably carried out by a physiotherapist. The initial spacing between the contact finger units 4.1, 4.2 in the longitudinal direction and in the transverse direction preferably match the typical dimensions of knees of men, women or, depending on the particular application, of children, so that the spacing is slightly above the extensions of typical knees in the longitudinal direction and in the transverse direction.

The retaining element 3 is preferably diamond-shaped or rhombus-shaped, wherein each tip of the rhombic retaining element 3 receives a contact finger unit 4.1, 4.2 and its associated adjustment unit 5. For more convenient handling of the patella gripper 1 the edges of the rhombic retaining element 3 are preferably curved inwards and as handle areas can carry out the function of a handle for moving the patella gripper 1.

Within the scope of rehabilitation therapy, the patella gripper 1 according to the invention can be used manually by a physiotherapist or by a patient. Said patella gripper 1 can, however, also be used as part of a device 20 for automatically moving a patella, as shown in FIGS. 3 to 7, wherein FIG. 7 shows the block diagram of the device 20.

For this purpose the device 20 preferably comprises an adapter 21 for connecting the patella gripper 1. The patella gripper 1 is designed to receive the adapter 21. The adapter 21 preferably comprises two height-adjustable gripper arms 22, which in the longitudinal direction are arranged laterally and parallel to each other side-by-side. The handle 2 is preferably removable from the retaining element 3 so that the adapter 21 can be placed between the handle 2 and the retaining element 3, wherein after the adapter 21 has been placed on the retaining element 3, which for this purpose preferably comprises corresponding click-in elements, the handle 2 can be detachably attached to the adapter 21 or again to the retaining element 3.

FIGS. 3 to 7 show a first exemplary embodiment 20 of a device according to the invention for moving a patella. The device 20 comprises a patella gripper 1 according to the invention according to a first exemplary embodiment, and a leg holding device 23 which preferably comprises support devices 35 for the lower leg and for the upper leg of a patient. The device 20 comprises an adjustment device 24 which, among other things, is used for adjusting the height of the patella gripper 1, and which adjustment device 24 is engaged by the gripper arms 22 of the adapter 21 so that they are height-adjustable, preferably in a click-in manner. As a result of the height adjustment of the gripper arms 22, by way of the adapter 21, the patella gripper 1 can be height-adjusted and in this manner can be lowered onto a knee of a patient. Furthermore, the adjustment device 24 is pivotable on a transverse axis, which preferably extends in the transverse direction, and is preferably also pivotable on a longitudinal axis, which extends in the longitudinal direction, so that the position of the patella gripper 1 on the patella can be optimised, depending on the position of the leg in the leg holding device 23. The device 20 according to the invention for moving a patella can be used both for right and for left legs. For transport purposes, the device 20 preferably comprises a locking mechanism so that the adjustment device 24 and the patella gripper 1 are locked into place.

Figure 4:
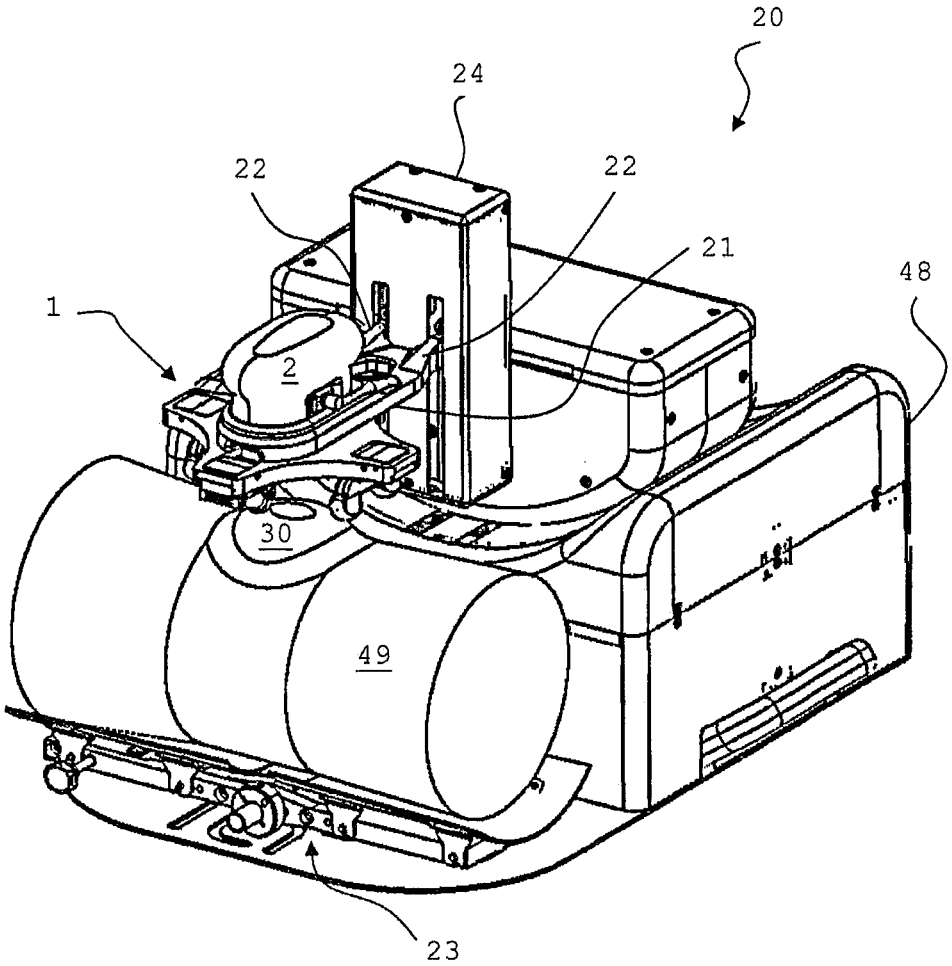
Figure 5:
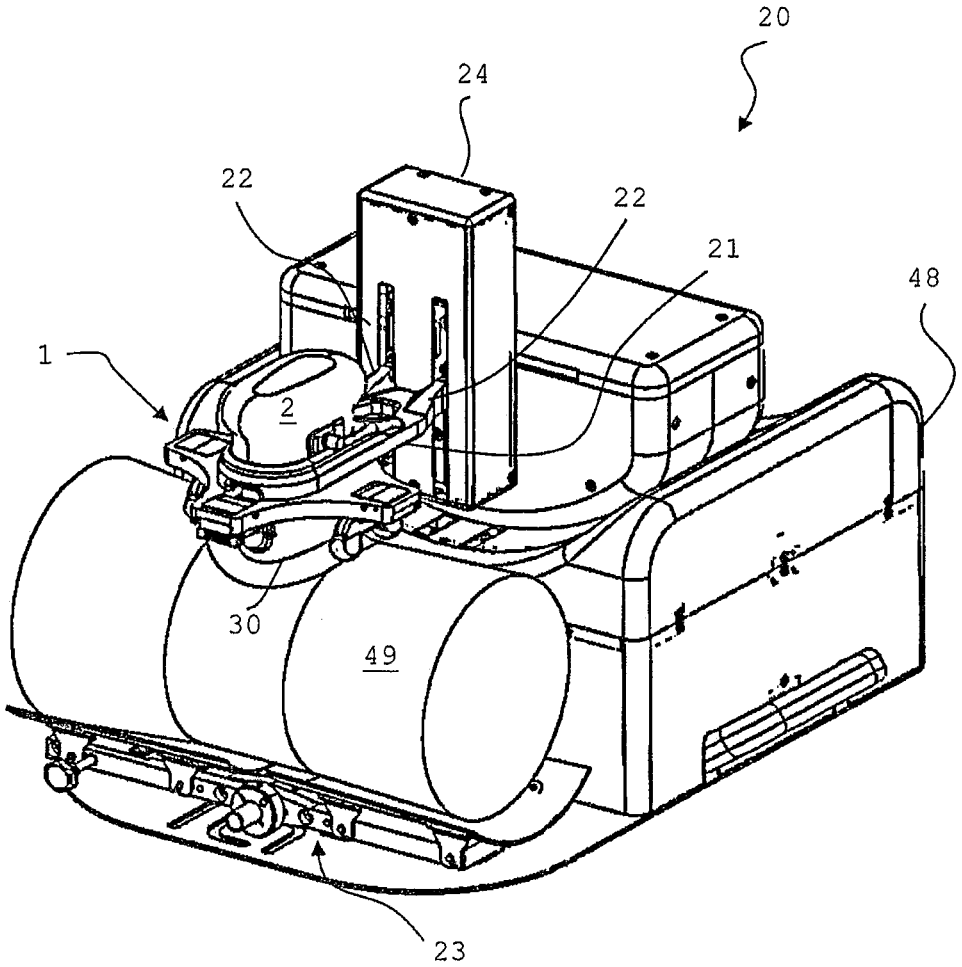
Figure 6:
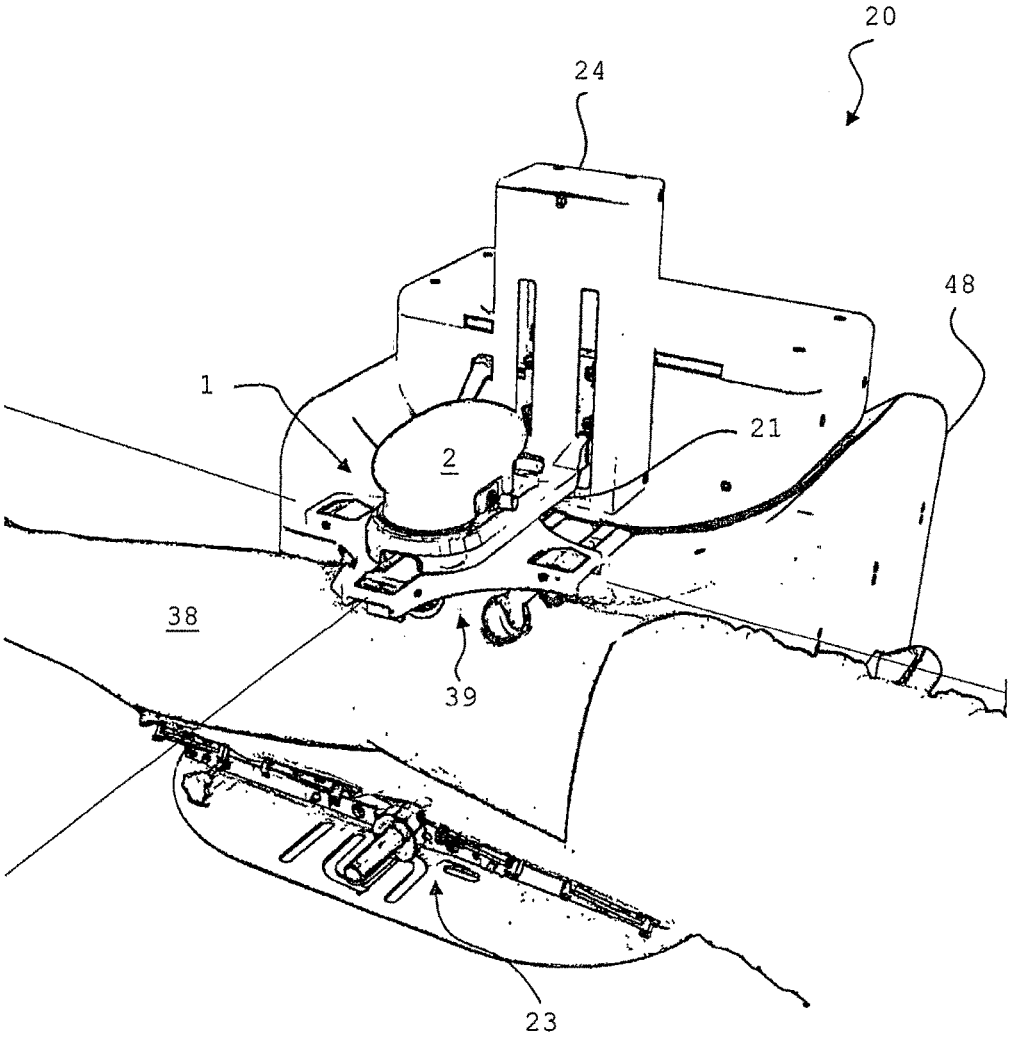
Figure 7:
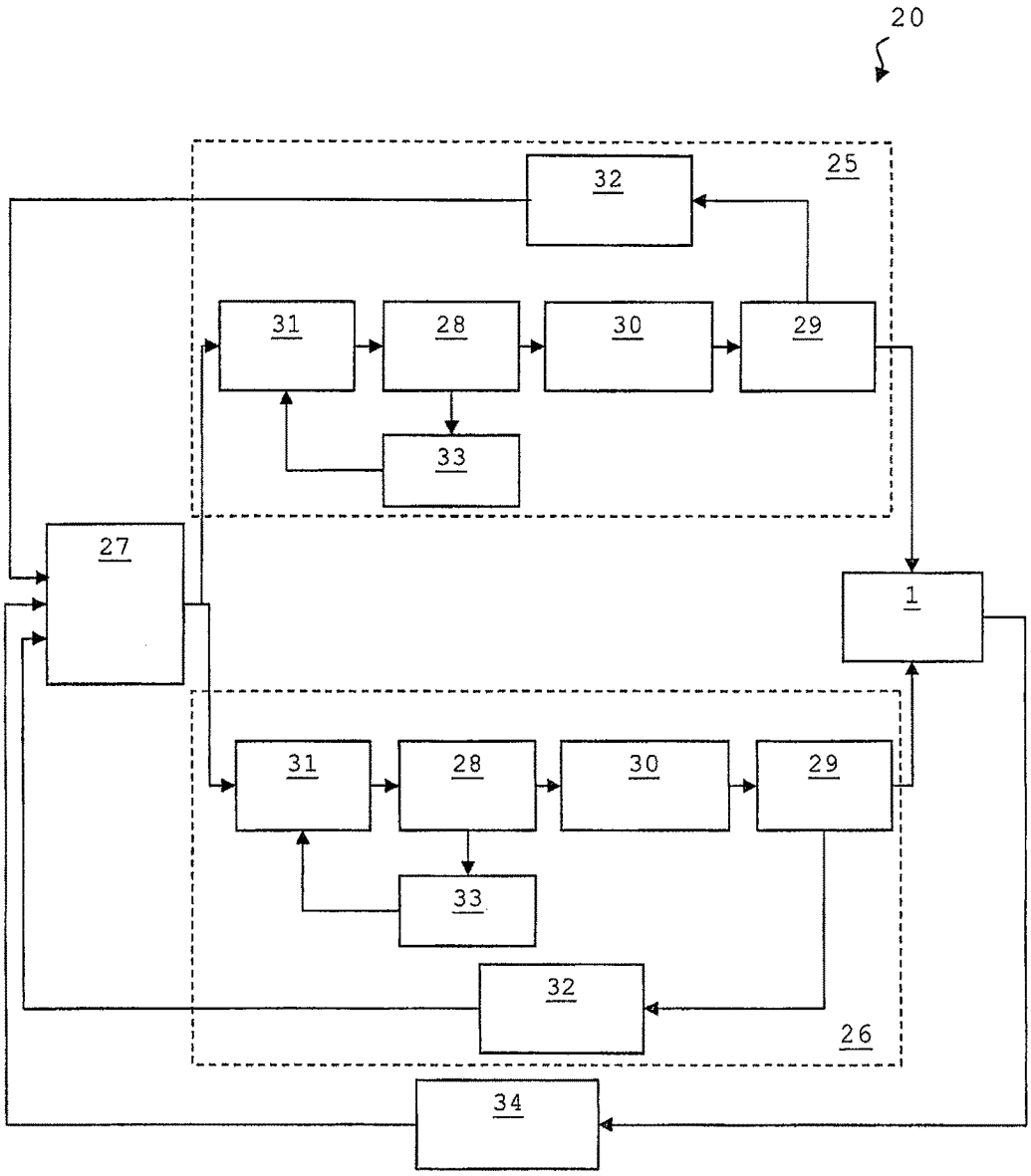

The device 20 further comprises a drive unit 25 for moving the patella gripper 1 in the cranial-caudal direction, i.e. in the longitudinal direction, a second drive unit 26 for moving the patella gripper 1 in the medial-lateral direction, i.e. in the transverse direction, and a control unit 27 for controlling, and preferably for regulating the first drive unit 25 and the second drive unit 26 (compare FIG. 7). For protection, the first drive unit 25, the second drive unit 26 and the control unit 27 are preferably accommodated in a shared housing 48. To supply energy to the device 20, preferably a battery (not shown) is used so that the device 20 can easily be transported. The battery is preferably also located in the housing 48. However, it is also possible, in addition or as an alternative to the power supply, to provide a connection for the electricity grid in a building. The first and the second drive units 25, 26 control the movement and position of the patella gripper 1 by way of the movement/position of the adjustment device 2. FIG. 4 shows the device 20 according to the invention for moving a patella with a diagrammatic illustration of a leg section 49 of a patient, wherein the leg section 49 comprises the knee 30 of the patient, and the patella gripper 1 is shown to be distant, in terms of height, from the leg section 49. The device 20 shown in FIG. 5 corresponds to the device 20 in FIG. 4, wherein in FIG. 5 the patella gripper 1 has been lowered onto the knee 30 by means of the adjustment device 24, thus gripping said knee 30. FIG. 6 corresponds to the illustration in FIG. 5, wherein the diagram shows a real leg 38 with a knee 39 that is gripped by the patella gripper 1.

FIG. 7 shows a block diagram of the device 20 according to the invention for moving a patella, which device 20 comprises a patella gripper 1 according to a first exemplary embodiment. By way of the first drive unit 25 the control unit 27 controls the cranial-caudal movement or the movement in the longitudinal direction of the patella gripper 1 and thus of the patella of a patient when the patella gripper 1 grips the patella. Furthermore, by way of the second drive unit 26 the control unit 27 controls the medial-lateral movement or the movement in the transverse direction of the patella gripper 1 and thus, in the placed-on state, of the patella of a patient. The first and the second drive units 25, 26 in each case comprise a motor 28, in particular an electric motor (preferably a direct current motor) and a linear guide unit 29, wherein the linear guide unit 29 of the first drive unit 25 moves the patella gripper 1 in the longitudinal direction, and the linear guide unit 29 of the second drive unit 26 moves the patella gripper 1 in the transverse direction. Between the respective motor 28 and the linear guide unit 29 associated with it, preferably in each case a transmission unit 30, in particular a gear unit, is provided, wherein the transmission unit 30 can comprise a clutch. In each case a power electronics unit 31 is arranged upstream of the motors 28, by way of which power electronics unit 31 the control unit 27 drives the motors 28. The power electronics units 31 can comprise power amplifiers. Furthermore, preferably various sensors are provided, which will be discussed below.

As has already been mentioned, the first and the second drive units 25, 26 are operated in such a manner that they move the patella gripper 1 according to a Cartesian coordinate system in the X-direction and in the Y-direction, i.e. in the longitudinal direction and in the transverse direction or in the cranial-caudal direction and in the medial-lateral direction.

For measuring the linear movement or for deflecting the patella gripper 1 in the cranial-caudal direction and in the medial-lateral direction a corresponding linear sensor unit 32, in particular a linear potentiometer, has been provided for each direction, which sensor unit 32 measures the extent of the positional change on the respective linear guide unit 29, and thus by way of the aforesaid measures the position/ deflection of the patella gripper in the longitudinal direction or in the transverse direction, and conveys the measured values to the control unit 27. The linear sensor units 32 are also referred to as position sensor units.

Furthermore, each motor 28 is associated with an encoder 33 that measures the position of the motor shaft and conveys it to the respective power electronics unit 31 and/or to the control unit 27. Depending on the values measured by the linear sensor units 32 and if applicable of the encoders 33, the control unit 27 regulates the patella gripper 1 by way of the first and the second drive units 25, 26. In particular to cover a case where the encoders 33 and/or the linear sensor units 32 fail, position limit switches (not shown) are preferably provided. If during movement of the patella gripper 1 a position limit switch is moved by a linear guide unit 29, this is detected by the control unit 27 as attaining the maximum permissible deflection, and for safety reasons the patella gripper 1 is moved back to the zero position by the control unit 27.

Furthermore, force sensors 34 are provided that measure the force applied on the patella gripper 1 and that transmit the measured force to the control unit 27. Also depending on the measured force, the control unit 27 regulates the patella gripper 1 by way of correspondingly controlling the first and the second drive units 25, 26. The force sensors 34 are preferably attached to the adapter 21, or are integrated in said adapter 21, and comprise strain gauges or are designed as such. As an alternative or in addition, the force sensors 34 can be arranged in the contact finger units 4.1, 4.2. Furthermore, preferably by corresponding current sensors (not shown), which are associated with the motors 28, the motor currents are monitored by means of the control unit 27 in order to prevent the occurrence of any unpleasant impact of the patella gripper 1 against the patella of a patient. Measuring the motor currents represents measuring that is redundant vis-à-vis force measuring and that serves to protect the patient. Furthermore, preferably a temperature sensor (not shown) is integrated in the device 20 in order to measure the temperature in the device for safety reasons so that any overheating can be detected. By providing sensors for various measured quantities, a redundant measuring system results that ensures patient safety and offers several options for monitoring the entire healing process of the patient.

By means of the force sensors 34, the linear sensor units 32, the position limit switches (not shown), the current sensors (not shown), the temperature sensor (not shown) and by means of monitoring and evaluating the measured values, fed back from the aforesaid, by the control unit 27, user safety of the device can be ensured for patients. The tolerable limit values relating to the measured values or quantities, in particular relating to the measured force and the measured positional change/deflection, depend on the particular patient and are therefore preferably determined, prior to the actual rehabilitation therapy, in the context of a teach-in phase and are stored in the device 20. Should the measured force exceed the limit value stored in relation to said force, the control unit 27 initiates a reversal of the movement of the patella gripper 1 so that the patella gripper 1 is moved back to the initial position. If the value relating to a motor current, which value has been measured by means of the current sensors (not shown), exceeds the limit value stored in relation to said motor current, the control unit 27 switches to a safety mode, in which the device 20 is automatically shut down by the control unit 27, and in which the linear guide units 29, by means of decoupling the motor 28 from the mechanical components of the transmission units 30, which decoupling is caused by the control unit 27, become freely movable so that the patella gripper 1 also becomes freely movable, wherein the respective clutch of the transmission units 30 is preferably of a magnetic design. Likewise, in the further measured values, such as the positional change/deflection and the temperature, exceeding the corresponding limit values, which have previously been stored, for safety reasons preferably result in the device 20 being switched to the safety mode by the control unit 27. If the limit value for the positional change/deflection is exceeded by the measured value, analogous to exceeding the limit value in relation to the force, it can, as an alternative, be provided that the control unit 27 moves the patella gripper 1 to the initial position. In the safety mode, speed setpoint values relating to the motor 28, which speed setpoint values have been predetermined by the control unit 27, are zeroed, the power electronics units 31 are deactivated, and the preferably magnetic clutches between the motors 28 and the mechanical parts of the transmission units 30 are disengaged. Monitoring any exceeding of the limit value can be carried out both by the control unit 27 and by a, preferably external, user interface, for example a laptop connected to the device 20.

Figure 8:
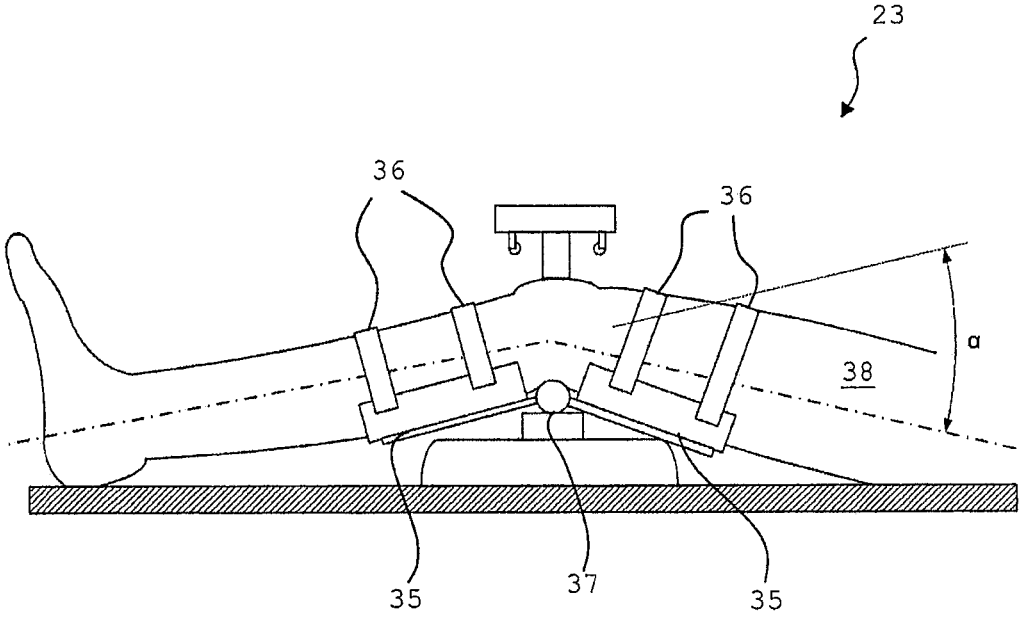

FIG. 8 shows the leg holding device 23 of the device 20, which leg holding device 23 comprises two support devices 35, wherein one support device 35 can receive an upper leg, and the other support device 35 can receive a lower leg of a patient. The leg holding device 23 is suitable for receiving a left leg or a right leg. For the purpose of holding a leg 38, holding belts 36 are used that are attached to the support devices 35. For therapeutic movement of the patella of a patient the leg 38 should either be in a stretched state or in a slightly bent state. Bending the leg 38 at an angle of more than 20 degrees can already impede mobility of the patella, because at such an angle the patella is usually already located in the femoral groove. The leg holding device 23 is designed in such a manner or is connected to the housing 48 of the device 20 in such a manner that it can be inclined, and consequently the patient can assume a comfortable position. The leg holding device 23 is, furthermore, attached to the housing 48 in such a manner that it is height-adjustable in order to improve patient comfort. Furthermore, the leg holding device 23 is designed in such a manner that the angular position of the support devices 35 relative to each other can be changed, which results in a change in knee flexion. To this effect the support devices 35 are interconnected by way of a corresponding joint 37. Bending of the knee can be defined by the angle a indicated in FIG. 8. Together with the adjustability, described above, of the patella gripper 1 by means of the preferably pivotable adjustment device 24, the adjustability of the leg holding device 23 makes it possible for the device 20 to be adjustable in relation to various leg morphologies and knee pathologies.

The device 20 is preferably operated by way of an external user interface (not shown) such as, for example, a laptop. By way of the external user interface the device 20 can be controlled, and the rehabilitation therapy, carried out by the device, on the knee of a patient can be displayed and monitored. To this effect it is possible, for example, to use the application program "Labview" that has been installed on the external user interface. In the external user interface various therapy phases can be stored for activation. For the purpose of connecting the external user interface the device 20 preferably comprises a corresponding interface (not shown) such as a serial interface, e.g. a USB-interface (USB: Universal Serial Bus), so that only one cable is used for connecting the external user interface to the device 20. As an alternative, the device can also communicate with an external user interface by means of wireless transmission technology, e.g. according to the Bluetooth protocol. Of course, the user interface can also be integrated in the device 20 and can be provided on the outside of the housing 48.

The application of the device 20 according to the invention for moving a patella preferably takes place in two consecutive phases. In the first phase the deflections/displacements or movements of the patella are taught to the device 20. This first phase represents a teach-in phase in which the device is adjusted in relation to a particular patient or is calibrated in relation to said patient. In the second phase the device 20 then carries out the taught or set movement of the patella.

The first phase or the teach-in phase at the beginning of rehabilitation therapy is used to adapt the device 20 to the specific pathology and morphology of a patient. In relation to the respective patient this teach-in phase, following its initial implementation, needs to be repeated only if parameters of the rehabilitation therapy have changed between two therapy sessions. The teach-in phase can be carried out by the device 20 manually, automatically or in an automated manner.

If the teach-in phase is carried out manually, for example by a physiotherapist, the physiotherapist moves the patella gripper 1 in order to move the patella in the cranial-caudal direction upwards and downwards, and in the medial-lateral direction from the inside towards the outside and back. By way of feedback from the respective patient the physiotherapist decides which maximum movements/deflections or displacements of the patella are still pain-free to the patient. The physiotherapist stores in the device 20 the force values/deflection values that correspond to these maximum movements/deflections or displacements, in particular by pushing corresponding buttons on the patella gripper 1. The force values/deflection values can also be stored in the device 20 by way of an internal or external user interface. The stored force values/deflection values are then, in the subsequent second phase, the actual therapy phase with successive therapy sessions, used by the device 20 for moving the patella of the respective patient by means of the patella gripper 1.

If the teach-in phase is carried out automatically or in an automated manner, the device 20 automatically and gently moves the patella gripper 1, e.g. after an activation button, provided on the device 20, for activating the teach-in phase has been pushed, with such movement being preferably in 2-millimeter steps, first in the cranial-caudal direction up and down, and then in the medial-lateral direction first to one side and then to the other side, until the patient starts to feel pain and signals this to the device 20, for example by letting go, or by renewed pushing of, the activation button or by operating a corresponding further activation button, so that the teach-in movement in the teach-in phase is interrupted, and the patella gripper 1 is moved back to its initial position by the control unit 27. Of course, the patella can also first be moved in the medial-lateral direction and thereafter in the cranial-caudal direction. During a change from the cranial-caudal direction to the medial-lateral direction or vice versa, the patella gripper 1 is preferably first moved back to its initial position. As an alternative or in addition to the activation button the device 20 can also be designed in such a manner that it processes acoustic signals of the patient and, for example in response to the word "stop" spoken aloud, interrupts the teach-in phase.

The force values/displacement values or deflection values that are current at the time of interruption of the teach-in phase are stored in the device 20 by way of the force sensors 34 and/or the linear sensor units 32. They can at any time and repeatedly be uploaded again, and are used by the device 20 in the subsequent second phase, during the therapy sessions, as values relating to the movement of the patella so that the teach-in phase does not have to be carried out at each therapy session, which results in the saving of time. Automatically carrying out the teach-in phase makes sense in particular for self-directed therapy by the patient, carried out in the patient's home. During progression of the first phase the patient can without further ado assume a relaxed and comfortable position.

During the second phase, the actual therapy phase, the control unit 27 controls the device 20 in such a manner that the patella gripper 1 carries out an even, rhythmical movement in order to displace the patella. The amplitude of deflection/displacement of the patella is gradually increased up to the values stored in relation to the deflections and/or forces in the respective direction (cranial-caudal or medial-lateral), so that pain-free treatment can be ensured.

By way of the, preferably external, user interface a physiotherapist can, for example by means of the application program "Labview", set parameters of rehabilitation therapy, e.g. the duration of each therapy session/therapy treatment in minutes and the cycle rate, i.e. the number of up-and-down movements in the cranial-caudal direction per minute, and the number of to-and-fro movements in the medial-lateral direction per minute.

In order to change from the cranial-caudal direction to the medial-lateral direction, the patella gripper 1 is led back, by the control unit 27, preferably to the centre position (initial position), which also represents the initial position or zero position of the patella gripper 1. Since the second phase runs fully automatically, it is completely repeatable and reproducible, even by patients themselves. The applied forces/displacements or deflections are preferably recorded by the device 20 and/or by the external user interface by means of the force sensors 34 and/or by means of the linear sensor units 32 so that it is possible not only to display and evaluate the result of each therapy session, in particular graphically on the user interface and/or on the device 20, but also to compare therapy results of several therapy sessions over an extended period of time. In this manner the healing progress can be recorded and monitored. Such a comparison of therapy results is of particular importance to the knee surgeon or to the physiotherapist in those cases where a patient carries out self-directed therapy and visits the clinic at regular intervals for checkups. Furthermore, graphically displaying the therapy results and the healing progress provides additional motivation for the patient to also carry out self-directed rehabilitation therapy at home, which in turn results in acceleration of the healing process. Moreover, consciously recording the therapy results helps to increase patients' self-discipline in carrying out self-directed rehabilitation therapy.

Figure 9:
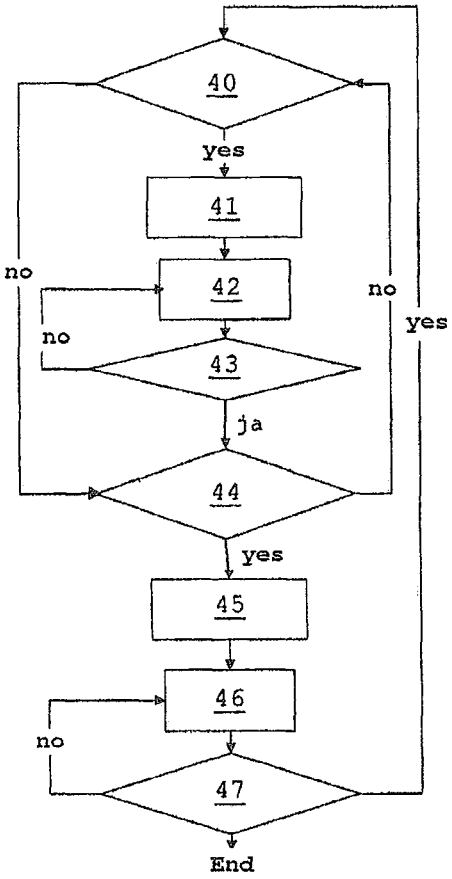

FIG. 9 shows the teach-in phase and the second phase (the actual therapy phase) separately in relation to the cranial-caudal direction and in relation to the medial-lateral direction. In a first step 40 the device 20 or a user of the device 20, e.g. a physiotherapist, checks whether the values relating to the movement of the patella in the medial-lateral direction have been set. If this is not the case, in step 41 the first phase, i.e. the teach-in phase, relating to the medial-lateral direction is carried out, either manually or automatically. After completion of the teach-in phase, in step 42 the second phase, relating to the medial-lateral direction, commences, in which phase the force values/deflection values stored in the teach-in phase are used by the control unit 27 for the purpose of controlling the patella gripper 1 and thus for moving the patella in the medial-lateral direction. The displacement/deflection of the patella in the medial-lateral direction takes place according to a predetermined cycle rate. In step 43 a check is made as to whether the cycle rate has been achieved. If this is the case, then in step 44 a check is made, either automatically or by the user, as to whether the values relating to the movement of the patella in the cranial-caudal direction have been set. If this is not the case, then in step 45 the teach-in phase relating to the cranial-caudal direction takes place either manually or automatically. On completion of the teach-in phase, in step 46 the second phase is carried out, analogously to step 42, relating to the cranial-caudal direction. In step 47 the number of displacements/deflections of the patella in the cranial-caudal direction is monitored (analogous to step 43), and the therapy session is terminated when the predetermined cycle rate has been achieved.

Of course, it is also possible to first carry out the steps 44, 45, 46, 47 in relation to the cranial-caudal direction, and thereafter to carry out the steps 40, 41, 42, 43 in relation to the medial-lateral direction. Furthermore, it is also possible to first check whether the values relating to the movements in the medial-lateral direction and in the cranial-caudal direction have been set (steps 40 and 44) and, depending on the results of this check, to carry out the teach-in phases in relation to both directions (steps 41 and 45), and to carry out the second phases, the actual therapy phases, in relation to both directions (steps 42, 43 and 46, 47) only after completion of both teach-in phases. During a change from the cranial-caudal direction to the medial-lateral direction or vice versa the patella gripper 1 is preferably first led back to the centre position (initial position) by the control unit 27.

Figure 10:
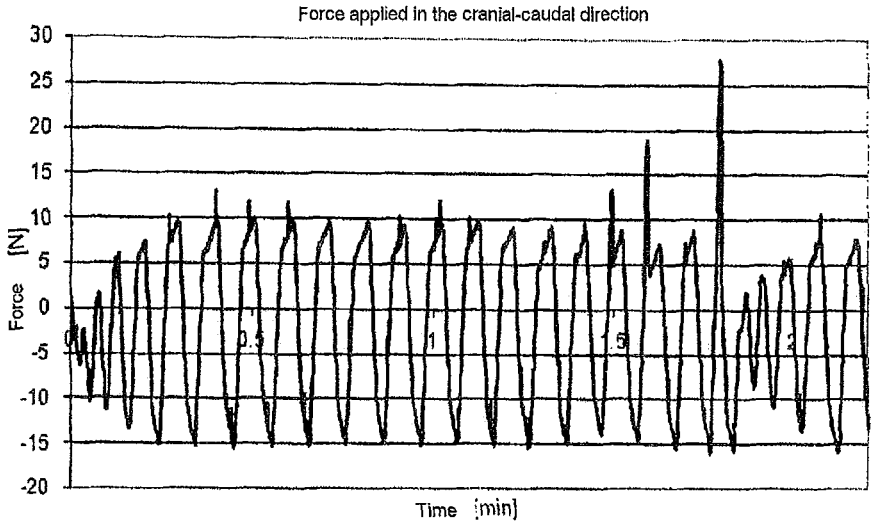

FIG. 10 shows an exemplary progression of the force applied by the device 20 for moving/deflecting the patella in the cranial-caudal direction during a therapy session over time. During a transient phase of 12 seconds the force values gradually increase. When a limit value relating to the force, which limit value has been stored in the device 20, is exceeded at approximately 1.8 minutes, the control unit 27 automatically reduces the amplitude of the force and thus of the deflection. The force varies according to the deflection and according to the direction of the deflection (i.e. in the cranial-caudal direction upwards towards the head of the patient, or downwards towards the feet of the patient). The greater the deflection of the patella, the greater is the force applied.

Figure 11:
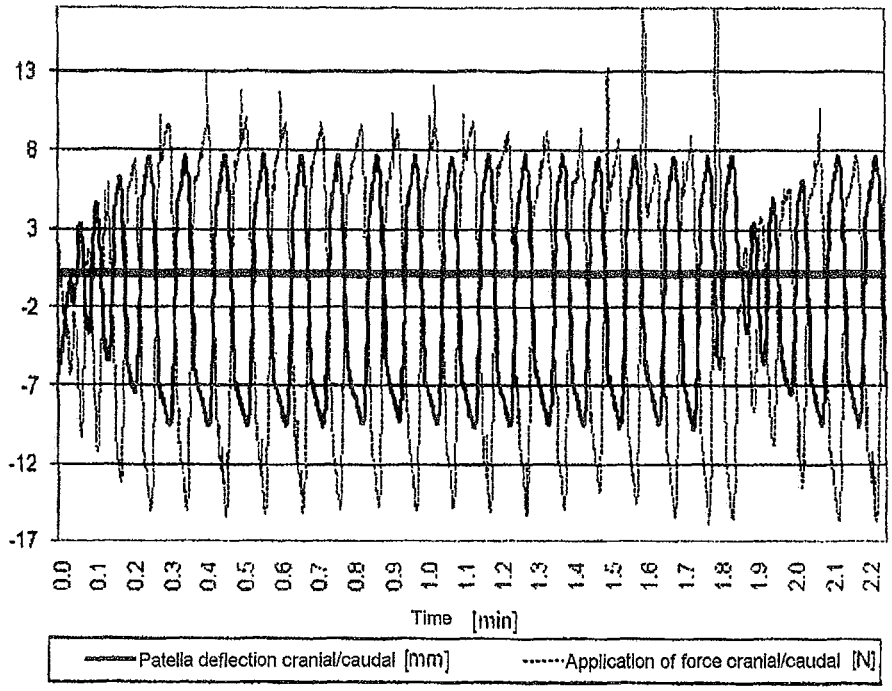

FIG. 11 shows exemplary progressions of the measured force values (dashed curve), and deflection values (solid curve) during a teach-in phase in the cranial-caudal direction, within which teach-in phase to begin with the maximum permissible force (the limit value relating to the force) was determined as 20 newtons and was stored in the device 20. To begin with, the deflection of the patella by means of the patella gripper 1 of the device 20 is uniformly and steadily increased in the direction of the head of the patient to 8 millimeters (−8 millimeters starting from the initial position or zero position of the patella gripper 1) and subsequently is increased in the direction of the end of the body that is opposite the head to 8 millimeters. The force values measured in this process oscillate between approximately −15 newtons (in the direction of the end of the body that is opposite the head) and approximately 10 newtons (in the direction of the head). After approximately 1.8 minutes of the teach-in phase, by way of the user interface and the control unit 27 an external force is applied to the patella by means of the patella gripper 1, which force exceeds the limit value, determined to begin with, of 20 newtons, in order to check whether monitoring the force values for exceeding the limit value functions. As shown in FIG. 10, the deflection and the force are automatically and immediately reduced by the device 20 by means of the control unit 27 when the force applied exceeds the stored limit value. If the measured force values exceed the force limit value, the patella gripper 1 is automatically and immediately moved back to its initial position by the control unit 27. After the thus resulting automatic reduction in the deflection and in the force, the device 20 starts a new teach-in phase, in which the force applied is again gradually increased. Measuring, by means of the force sensors 34, the force applied, and providing feedback of the measured force values to the control unit 27 ensure pain-free treatment of the patient. If the current limit value relating to one of the motor currents is exceeded, the drive units 25, 26 are automatically and immediately deactivated by the control unit 27, the speed setpoint values relating to the motors 28 are zeroed, and the linear guide units 29 are made to freewheel.

Figure 12:
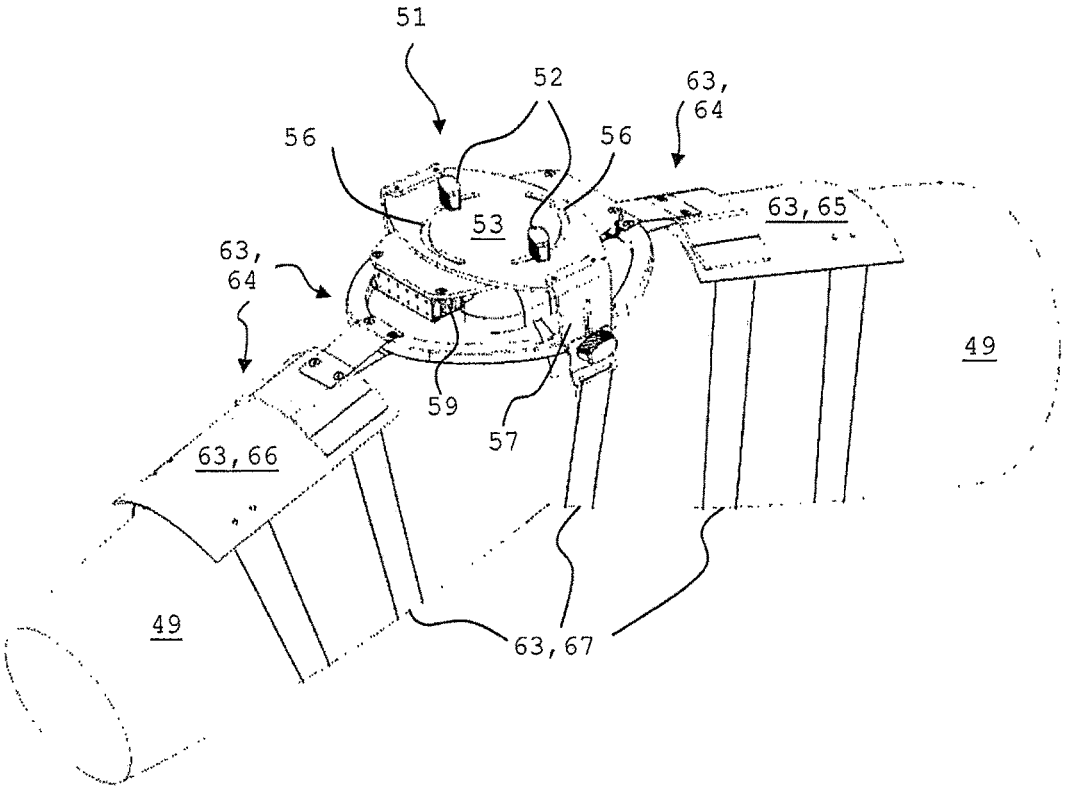
Figure 13:
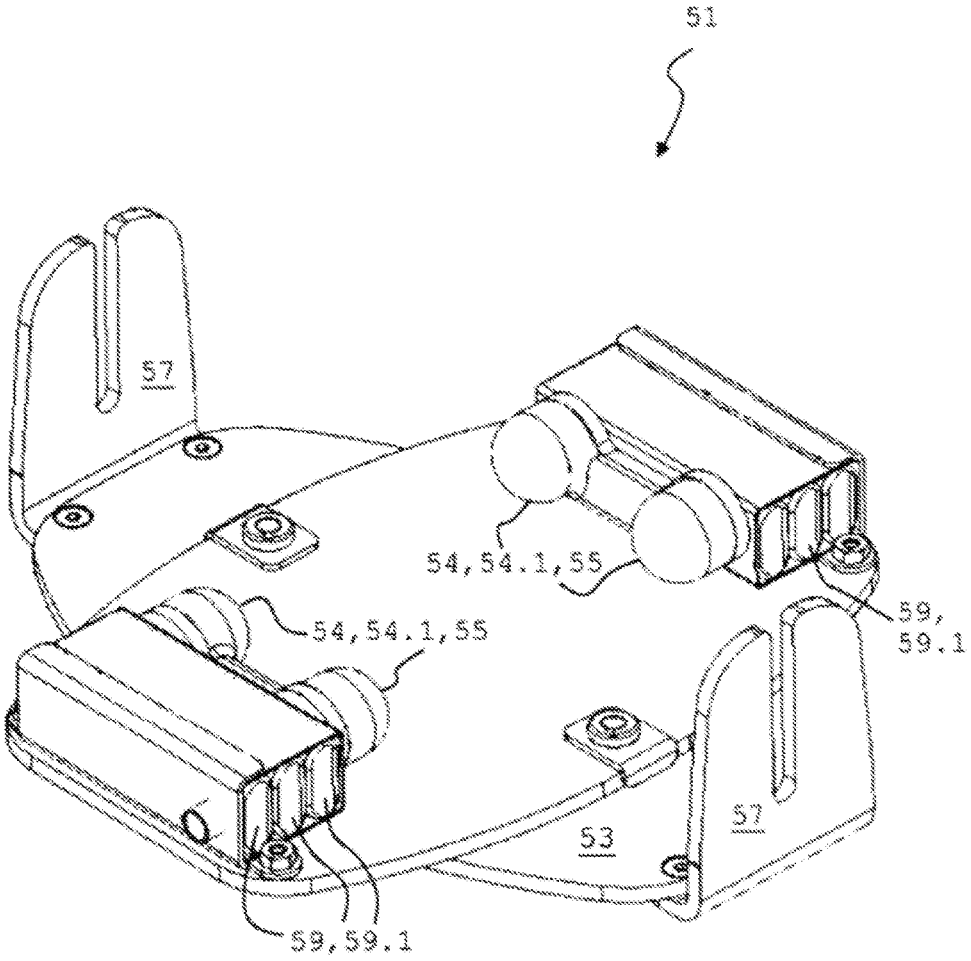

FIGS. 12 and 13 show a second exemplary embodiment 51 of a patella gripper according to the invention, by means of which patella gripper a patella can be moved. The patella gripper 51 comprises a retaining element 53, on whose lower face a contact finger apparatus 54 is arranged. The contact finger apparatus 54 comprises two contact finger units 54.1, arranged on opposite sides on the lower face of the retaining element 53, which contact finger units 54.1 in each case comprise at least one contact finger 55, preferably in each case two contact fingers 55. As far as the contact fingers 55 or any protective hoods 61 that may be provided for them is concerned, the explanations presented above in relation to the first exemplary embodiment 1 of the patella gripper according to the invention apply.

The contact finger apparatus 54 and thus the contact finger units 54.1 are rotatably arranged on the retaining element 53 so that the contact finger units 54.1 can be moved from a position in the longitudinal direction on opposite sides of the transverse axis of the retaining element 53 (for moving the patella in the cranial-caudal direction or in the longitudinal direction) to a position in the transverse direction on opposite sides of the longitudinal axis of the retaining element 53 (for moving the patella in the medial-lateral direction or in the transverse direction) and vice versa. For this purpose the contact finger apparatus 54 is preferably rotatable by at least 90 degrees. For rotating the contact finger apparatus 54 the retaining element 53 preferably comprises at least one arc-shaped opening 56, preferably two arc-shaped openings 56. On the upper face of the retaining element 53 a corresponding number of handles 52 for rotating the contact finger apparatus 54 are provided, wherein the one or several handles 52 is/are connected with the contact finger apparatus 54, and preferably a handle 52 is connected to the contact finger apparatus 54 by way of an opening 56.

Each contact finger unit 54.1 is associated with a fluidic actuator 59, wherein the term "fluidic" includes the notions of both pneumatic and hydraulic. Preferably the actuators are pneumatic. Each fluidic actuator 59 can, for example, be a cushion that can be filled with a fluid, wherein each cushion can comprise several (preferably three) fillable chambers 59.1 that are arranged one behind the other, i.e. sequentially. The fluidic actuators 59 are preferably arranged between the respective contact finger unit 54.1 and the edge of the retaining element 53; they act on the respective contact finger unit 54.1. Each contact finger unit 54.1 has thus been placed on a fluidic actuator 59.

The fluidic actuators 59 are preferably driven by way of a fluidic pump 58 or are filled with fluid, wherein the fluidic pump 58 forms part of a second exemplary embodiment 60 of a device according to the invention for moving a patella. The device 60 according to the invention is shown as a block diagram in FIG. 14.

FIG. 12, in addition to the patella gripper 51, shows the leg holding device 63 of the device 60 according to the invention, wherein the patella gripper 51 is installed on a leg brace 64 of the leg holding device 63, which leg brace 64 can be placed on the upper face of a leg. The leg brace 64 preferably comprises an opening for the knee, above which opening the patella gripper 51 is arranged, as are receiving devices 65 and 66 for the upper leg and for the lower leg, against which receiving devices the upper leg and the lower leg can rest. Preferably, the angle between the receiving devices 65 and 66 can be varied/set, which results in a change in knee flexion. By way of setting the angle between the receiving devices 65 and 66 the leg of the patient can be angled or stretched again for the therapeutic movement of the patella. For attachment of the receiving devices 65 and 66 and of the patella gripper 51 to the leg 49 of a patient, holding belts 67 are provided that form part of the leg holding device 63. FIG. 12 shows the patella gripper 51 spaced apart from the leg 49 of the patient so as to provide a clearer illustration.

The patella gripper 51 preferably comprises an adjustment device 57 by means of which the height of the patella gripper 51 can be adjusted relative to the knee. The adjustment device 57, and thus the patella gripper 51 rigidly connected to it, can preferably by pivoted on the transverse axis so that the position of the patella gripper on the patella of the patient can be optimised. The patella gripper 51 and the device 60 can be used for right and for left patellae or legs. For the purpose of transporting the device 60 the receiving devices 65, 66 of the leg holding device 63 are folded closed or folded down, preferably underneath the patella gripper 51.

By rotating the contact finger apparatus 54, the patella can be mobilised, both in the cranial-caudal direction and in the medial-lateral direction, by means of the contact finger units 54.1. For mobilising the patella in one of the above-mentioned directions, the contact finger units 54.1 are correspondingly moved by means of the fluidic actuators 59, for which purpose the fluidic actuators 59 are controlled by a fluidic pump 58, wherein depending on the direction of movement (to or fro) one of the fluidic actuators 59 is filled with fluid. By introducing fluid into one of the fluidic actuators 59, the latter is filled and in this process extended, and consequently moves the associated contact finger unit 54.1 in the direction of its extension, as a result of which, because of the action of force from the contact finger unit 54.1, again, the patella is moved in the corresponding direction.

As has already been described, the contact finger apparatus 54 of the patella gripper 51 can be rotated in such a manner that the contact finger units 54.1, by way of the fluidic actuators 59, are movable to and fro, firstly in the cranial-caudal or caudal-cranial direction (in other words in the longitudinal direction) and secondly in the medial-lateral direction (in other words in the transverse direction) so that the patella can be mobilised in the corresponding direction. The one contact finger 55 or the several contact fingers 55 of the contact finger units 54.1 transmit the force that has been introduced by way of the fluidic actuators 59 in a targeted manner to the patella.

Figure 14:
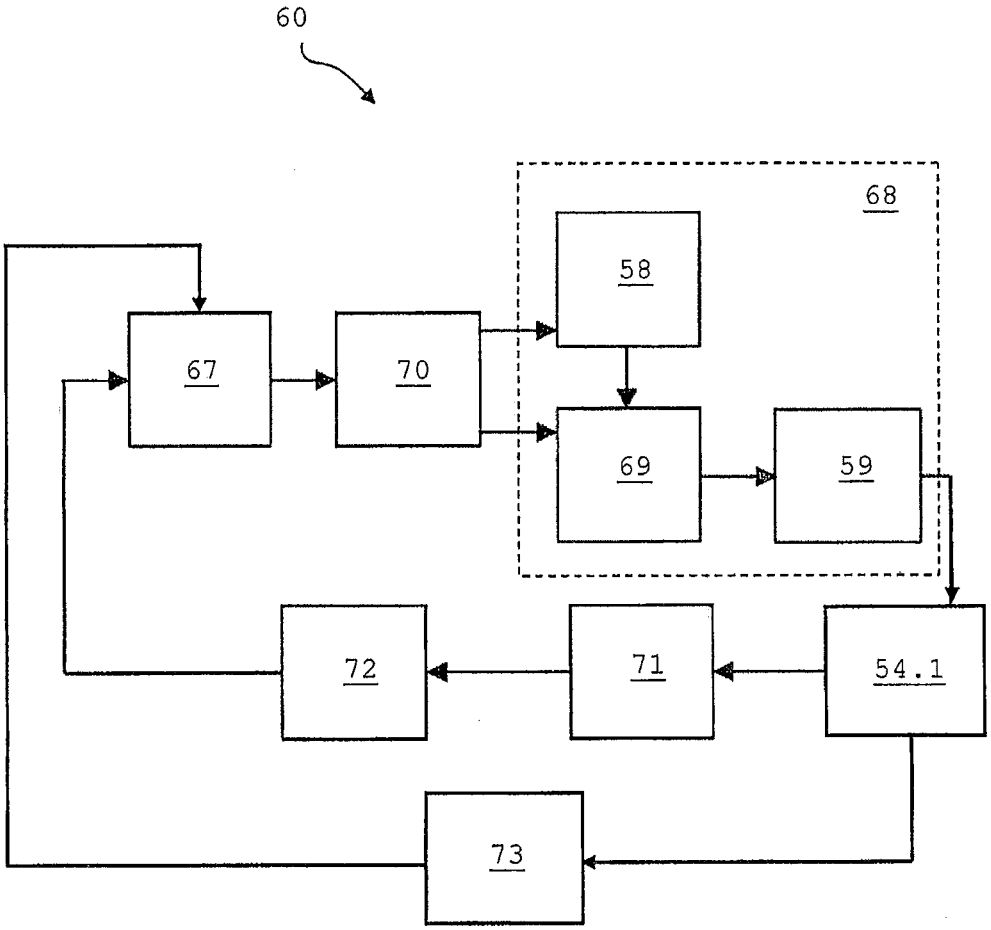

FIG. 14 shows a block diagram of the device 60 according to the invention for moving a patella. The device 60 comprises a control unit 67 for controlling or regulating the drive unit 68, formed by the fluidic pump 58 and the fluidic actuators 59, for the contact finger units 54.1, wherein the control unit 67 and the fluidic pump 58 for protection are preferably accommodated in a separate housing (not shown). By way of valves 69 the fluidic pump 58 is connected to the fluidic actuators 59, which also form part of the drive unit 68. The valves 69 and the fluidic pump 58 are controlled or regulated by the control unit 67 by way of the power electronics unit(s) 70.

The control unit 67 controls/regulates the movement of the patella by way of the control system of the fluidic pump 58 which then depending on the desired direction of movement conveys fluid to one of the fluidic actuators 59, wherein, by means of prior rotation of the contact finger apparatus 54 by 90 degrees, moving the patella in the longitudinal direction or in the transverse direction can take place. As a result of the supply of fluid to a fluidic actuator 59, the aforesaid exerts pressure on the associated contact finger unit 54.1 and moves the aforesaid (and thus the patella) in the desired direction.

Preferably, pressure sensor units 71 are provided which, in particular, measure the pressure applied by the fluidic actuators 59, and convey the measured pressure value to a pressure regulator 72, which compares the measured pressure value with a stored target pressure value and, in particular, adjusts it to said target pressure value by way of a corresponding signal to the control unit 67. Furthermore, the sensors or sensor units described in the context of the patella gripper 1 and the device 20, or at least some of said sensors or sensor units, can be provided. Supplying energy to the device 60 can take place as described further above in relation to the device 20. The same applies analogously to operation, or to an external user interface, of the device 20. Furthermore, linear sensor units 73 are preferably provided that measure the deflection of the contact finger units 54.1 and transmit the measured values to the control unit 67. By means of the pressure sensor units 71 and the, preferably additionally provided, linear sensor units 73 and by means of monitoring and evaluating the measured values fed-back by the aforesaid by the control unit 67, user safety of the device 60 can be ensured for the patient.

Of course, in the first exemplary embodiment of a patella gripper 1 according to the invention and in the first exemplary embodiment of a device 20 according to the invention for moving a patella, as shown in FIGS. 1 to 8, movement of the patella gripper 1 by means of a fluidic pump and fluidic actuators can also be provided, as is provided in relation to the second exemplary embodiment 51 of a patella gripper according to the invention and to the second exemplary embodiment 60 of a device for moving a patella according to FIGS. 12 to 14. Correspondingly, in the patella gripper 51 and in the device 60 it is also possible to provide one or several drive units for the contact finger units 54.1, with each drive unit comprising a motor, in particular an electric motor, and a linear guide unit. Furthermore, the device 20 can comprise a leg holding device as shown in FIG. 12. Correspondingly, the device 60 can comprise a leg holding device as shown in FIG. 8.

In the method described in relation to the flow chart shown in FIG. 7, in the patella gripper 51 and in the device 60, rotation of the contact finger apparatus 54 by 90 degrees takes place between a change in the direction of movement of the patella from the longitudinal direction to the transverse direction or vice versa. Furthermore, only one drive unit 68 and only one contact finger unit 54.1 are present, which advantageously can be used both for mobilising the patella in the longitudinal direction, and also (by rotating them) for mobilising the patella in the transverse direction.

While in the present application preferred embodiments or designs of the invention are described, it should clearly be pointed out that the invention is not limited to these and can also be implemented in other ways within the scope of the following claims.

The invention claimed is:

1. A device for moving a patella with a patella gripper for a patella, comprising:

the patella gripper comprising:

a retaining element having a lower face and a contact finger apparatus, which is arranged on the lower face of the retaining element and is configured to grip the patella, wherein the contact finger apparatus comprises at least two contact finger units, which are arranged on opposite sides of the retaining element, wherein the contact finger apparatus is rotatably arranged on the retaining element so that the contact finger apparatus can be rotated on an axis that is aligned perpendicularly to the longitudinal axis of the retaining element and perpendicularly to the transverse axis of the retaining element, and wherein the contact finger apparatus is adapted to move the patella in one of the cranial-caudal direction and in the medial-lateral direction by the at least two contact finger units;

a leg holding device configured to receive a leg of a patient;

one or more drive units for moving the at least two contact finger units; and a control unit for controlling the one or more drive units, wherein the at least two contact finger units are moved linearly with respect to at least one of the retaining element and the leg holding device by the one or more drive units.

2. The device according to claim 1, wherein the at least two contact finger units comprise one or several contact fingers, each contact finger having at least one end.

3. The device according to claim 2, wherein the ends of the contact fingers, which ends are further away from the retaining element, are spherical in shape.

4. The device according to claim 2, wherein the contact fingers of the contact finger units at the ends located away from the retaining element comprise protective hoods.

5. The device according to claim 4, wherein the protective hoods comprise silicon as a material.

6. The device according to claim 1, wherein each contact finger unit comprises two contact fingers.

7. The device according to claim 1, wherein each contact finger unit is associated with a fluidic actuator.

8. The device according to claim 1, wherein the contact finger units are arranged on the retaining element so as to be height-adjustable.

9. The device according to claim 1, wherein a handle for at least one of guiding the patella gripper and rotating the contact finger apparatus is provided, which handle is arranged on the upper face of the retaining element.

10. The device according to claim 9, wherein the handle is arranged in the center on the upper face of the retaining element.

11. The device according to claim 1, wherein the one or more drive units each comprise a motor and a linear guide unit.

12. The device according to claim 1, wherein the one or several drive units comprise a fluidic pump and a fluidic actuator and in particular one or more valves.

13. The device according to claim 1, wherein at least one of linear sensor units for measuring the deflection of the patella gripper or of the contact finger units are provided, and force sensors and pressure sensor units for measuring the force applied by the patella gripper or by the contact finger units are provided.

14. The device according to claim 1, wherein the leg holding device is at least one of height-adjustable and adjustable in terms of its inclination and adjustable for various instances of knee flexion.

15. The device according to claim 1, wherein an adjustment device for the patella gripper is provided, by means of which the height of the patella gripper can be adjusted.

16. The device according to claim 15, wherein the adjustment device is pivotable.

17. The device according to claim 1, wherein the contact finger units are moved linearly with respect to the leg holding device by means of the one or more drive units.

18. The device according to claim 1, wherein the contact finger units are moved linearly with respect to the retaining element and the leg holding device by means of the one or more drive units.

19. The device according to claim 1, wherein the contact finger units are moved linearly with respect to the leg holding device by means of the one or more drive units for repeatedly deflecting the patella from its normal position.

20. A device for moving a patella with a patella gripper for a patella, comprising:

the patella gripper comprising:

a retaining element having a lower face and a contact finger apparatus, which is arranged on the lower face of the retaining element and is configured to grip the patella, wherein the contact finger apparatus comprises at least two contact finger units, which are arranged on opposite sides of the retaining element, and wherein the contact finger apparatus is adapted to move the patella in one of the cranial-caudal direction and in the medial-lateral direction by the at least two contact finger units;

a leg holding device configured to receive a leg of a patient;

one or more drive units for moving the at least two contact finger units; and a control unit for controlling the one or more drive units, wherein the at least two contact finger units are moved linearly with respect to at least one of the retaining element and the leg holding device by means of the one or more drive units, and an adjustment device for the patella gripper, the adjustment device being configured to adjust the height of the patella gripper and being pivotable.

* * * * *